US009388365B2

(12) United States Patent
Delcotto et al.

(10) Patent No.: US 9,388,365 B2
(45) Date of Patent: Jul. 12, 2016

(54) WOODEN WICKS INCLUDING A BOOSTER FOR A CANDLE AND METHOD OF MAKING

(71) Applicant: Delcotto IP, LLC, North Huntingdon, PA (US)

(72) Inventors: Melynda Suzanne Delcotto, North Huntingdon, PA (US); Justin Damiani, Youngwood, PA (US)

(73) Assignee: DELCOTTO IP, LLC, North Huntingdon, PA (US)

( * ) Notice: Subject to any disclaimer, the term of this patent is extended or adjusted under 35 U.S.C. 154(b) by 0 days.

(21) Appl. No.: 14/802,468

(22) Filed: Jul. 17, 2015

(65) Prior Publication Data

US 2015/0322379 A1 Nov. 12, 2015

Related U.S. Application Data

(63) Continuation of application No. 13/296,629, filed on Nov. 15, 2011, which is a continuation-in-part of application No. 12/002,819, filed on Dec. 19, 2007, now Pat. No. 8,708,694.

(60) Provisional application No. 60/871,264, filed on Dec. 21, 2006.

(51) Int. Cl.

| | |
|---|---|
| ***F23D 3/02*** | (2006.01) |
| ***C11C 5/00*** | (2006.01) |
| ***B27D 1/00*** | (2006.01) |
| ***C11C 5/02*** | (2006.01) |
| ***B27M 1/08*** | (2006.01) |
| ***F23D 3/08*** | (2006.01) |
| ***F23D 3/16*** | (2006.01) |

(52) U.S. Cl.
CPC . *C11C 5/006* (2013.01); *B27D 1/00* (2013.01); *B27M 1/08* (2013.01); *C11C 5/02* (2013.01); *F23D 3/08* (2013.01); *F23D 3/16* (2013.01)

(58) Field of Classification Search
USPC ..... 431/289, 288, 291
See application file for complete search history.

(56) References Cited

U.S. PATENT DOCUMENTS

| | | | |
|---|---|---|---|
| 52,231 | A | 1/1866 | Walton |
| 59,839 | A | 11/1866 | Hoard |
| 123,917 | A | 2/1872 | Ladd |
| 133,973 | A | 12/1872 | Everett |

(Continued)

FOREIGN PATENT DOCUMENTS

| | | | |
|---|---|---|---|
| FR | 2639356 | A1 | 5/1990 |
| FR | 2725372 | A1 | 4/1996 |

(Continued)

OTHER PUBLICATIONS

Olden, D., "Candles That Earn", Peanut Butter Publishing, (1990), Chapter 8, pp. 153-160.

(Continued)

*Primary Examiner* — Avinash Savani
(74) *Attorney, Agent, or Firm* — The Webb Law Firm

(57) ABSTRACT

A wooden wick for use in a wax candle comprising a strip of predetermined wood having each of a first predetermined length, a first predetermined width and a first predetermined thickness. Such wick further includes a wood booster member having each of a second predetermined length, a second predetermined width and a second predetermined thickness adhered to the strip of wood.

20 Claims, 4 Drawing Sheets

(56) References Cited

U.S. PATENT DOCUMENTS

| | | | | |
|---|---|---|---|---|
| 170,995 | A | 12/1875 | Daniels | |
| 239,855 | A | 4/1881 | Schneider | |
| 252,590 | A | 1/1882 | Loper | |
| 276,602 | A | 5/1883 | Kirk | |
| 383,822 | A | 5/1888 | Munger | |
| 415,231 | A | 11/1889 | Walters | |
| 431,033 | A | 7/1890 | Chapin | |
| 486,966 | A | 11/1892 | Elsinger | |
| 731,033 | A | 6/1903 | Freeman | |
| 747,282 | A | 12/1903 | Wallgren | |
| 2,570,841 | A | 10/1951 | O'Connor | |
| 2,758,460 | A | 8/1956 | Ciano | |
| 3,428,409 | A * | 2/1969 | Summers | 431/289 |
| 3,582,251 | A | 6/1971 | Concannan | |
| 3,652,197 | A | 3/1972 | Tokarz | |
| 4,380,200 | A | 4/1983 | Reninger | |
| 4,381,914 | A | 5/1983 | Ferguson | |
| 4,386,904 | A | 6/1983 | Miyahara et al. | |
| 5,354,197 | A | 10/1994 | Barone | |
| 5,690,484 | A | 11/1997 | Leonard et al. | |
| 6,068,472 | A | 5/2000 | Freeman et al. | |
| 6,444,156 | B1 | 9/2002 | Schwarz et al. | |
| 6,921,260 | B2 | 7/2005 | Garnys | |
| 7,568,913 | B2 | 8/2009 | Decker et al. | |
| D644,359 | S | 8/2011 | Decker | |
| D678,558 | S | 3/2013 | Decker | |
| 2004/0009447 | A1 | 1/2004 | Decker | |
| 2005/0037308 | A1 | 2/2005 | Decker | |

FOREIGN PATENT DOCUMENTS

| | | | |
|---|---|---|---|
| FR | 2726573 | A1 | 5/1996 |
| FR | 2811676 | A1 | 1/2002 |

OTHER PUBLICATIONS

Olden, D., "Candles That Earn", Peanut Butter Publishing, (1990), Chapter 7, pp. 133-153.

* cited by examiner

WOODEN WICKS INCLUDING A BOOSTER FOR A CANDLE AND METHOD OF MAKING

CROSS REFERENCE TO RELATED APPLICATIONS

This application is a Continuation of U.S. patent application Ser. No. 13/296,629, filed Nov. 15, 2011, entitled Wooden Wicks Including a Booster for a Candle and Method of Making, which is a Continuation-In-Part of U.S. patent application Ser. No. 12/002,819, filed Dec. 19, 2007 (now U.S. Pat. No. 8,708,694), and claims priority to U.S. Provisional Patent Application No. 60,871,264 filed Dec. 21, 2006, which are incorporated herein by reference in their entirety.

BACKGROUND OF THE INVENTION

1. Field of the Invention

The present invention relates, in general, to wicks for candles and, more particularly, this invention relates to a wooden wick equipped with a booster for a candle and to a method of making such wooden wick.

2. Description of Related Art

Prior to the conception and development of the present invention, as is generally well-known in the prior art, candles and wicks which are lit to provide a flame and which melts the wax surrounding such wicks have been in existence and commercially available for many years.

These prior art type wicks have normally been produced from a cloth fiber and are embedded into an appropriate portion of the wax, generally in the center, forming the candle. Wicks formed from pieces of wood have also been used; however, these wooden wicks have been formed as a single piece of wood which has a number of distinct disadvantages.

One particular disadvantage of these prior art type wooden wicks is that they are not attractive. Another important disadvantage of the prior art wooden wicks is that they have less than ideal burn qualities (e.g., smoke and soot emitted, inconsistent burning of wick, inconsistent wax burning, etc.).

SUMMARY OF THE INVENTION

The present invention provides, in a first aspect, a wooden wick for use in a wax candle. This wooden wick includes a strip of a predetermined wood having each of a first predetermined length, a first predetermined width and a first predetermined thickness. Such wick further includes a booster member having each of a second predetermined length, a second predetermined width and a second predetermined thickness and a means for adhering the booster member to such strip of wood. The booster member can be constructed from wood to form a strip of wood.

In a second aspect, the present invention provides a method of manufacturing a wooden wick for use in a wax candle. The method includes the steps of selecting a type of wood to be formed into a strip of wood to be used in the wooden wick. Thereafter, cutting such wood selected into a strip having each of a first predetermined length, a first predetermined width and a first predetermined thickness.

The method includes the steps of selecting a type of wood to be formed into a strip of wood to be used in a booster member, then cutting such wood selected into such strip having each of a first predetermined length, a first predetermined width and a first predetermined thickness and adhering such booster member to the strip of wood forming the wick.

Preferably, the wicks and booster are constructed of all natural components. The booster is a very important part of the wick, which enables the wick to burn in natural candle wax. A single piece of wood will not burn well in natural wax. Also an untreated wood will not burn consistently through a natural wax. Natural waxes should be considered as any waxes derived from animal or plant sources. Preferably a vegetable wax, such as soy wax, jojoba wax, bayberry wax, candelilla wax, carnauba wax, castor wax or a combination thereof, is used.

An important benefit to having two wood pieces as a wick is that this allows for optimization of the wick's burning properties by selecting different sizes and species of wood for the wick and booster components. The wood can be any combination of species depending on the heat output that is desired. Cherry, oak, birch, maple, balsa, and rosewood species are examples of woods that could be used in constructing the wick.

The wood is cut into sheets or strips of a desired thickness. Once cut, the wood of the wick and the booster are treated. The wood is sprayed with a coating of a solution of soy oil, salt water and vinegar. In a specific example, a solution of 60% soy oil, 30% salt water and 10% white distilled vinegar is effectively used. The soy oil aids in a consistent burn of the wick. While the salt water aids in increasing the moisture content of the wick. The vinegar acts a natural anti-fungal to prevent fouling of the wick during storage and shipping.

After treatment with the above solution the wood is then placed into a plastic bag and placed into a vacuum to pull the solution into the wood. The wood may be maintained in a vacuum for several hours to several days to fully pull the solution into the wood. When the wood is removed from the vacuum it may be cut further into the desired sizes. The booster is then glued to the base piece with an all natural vegetable glue, the glue is applied in an S pattern, this allows the booster to act as a chimney for the steam that is created by the additional water in the solution that was infused into the wood, while the soy oil assures that the wood will be able to burn hot enough to melt natural candle waxes. The glue or adhesive could be applied in other patterns or in place, of or in combination with, other glue application patterns. While an S pattern has been found to be very effective in regard to wick performance and manufacturing efficiency, other patterns that allow for a chimney effect to occur and keep the wick components closely bound could also be effective.

After treatment with the above solution the wood is then placed into a plastic bag and placed into a vacuum to pull the solution into the wood. The wood may be maintained in a vacuum for several hours to several days to fully pull the solution in the wood. When the wood is removed from the vacuum it may be cut further into the desired sizes. The booster is then glued to the base piece with a all natural vegetable glue, the glue is applied in a S pattern, this allows the booster to act as a chimney for the steam that is created by the additional water in the solution that was infused into the wood, while the soy oil assures that the wood will be able to burn hot enough to melt natural candle waxes. The glue or adhesive could be applied in other patterns or in place of or in combination with other glue application patterns. While an S pattern has been found to be very effective in regard to wick performance and manufacturing efficiency, other patterns that allow for a chimney effect to occur and keep the wick components closely bound could also be effective.

Once the glue is applied to the wood pieces, they can be placed on presser boards to dry and keep the wood flat. Low heat is applied to assist in the drying process of the wood wicks. An oil is then applied, preferably by spraying, to the wood pieces of the wick. Preferably a vegetable oil such as soy oil is used, but other oil or wax formulations could be used if they have the needed burn qualities. The wood is then wrapped in a plastic wrap or the like to protect the moisture level of the wicks.

Once constructed the wicks can be used as a wick in a candle by embedding the wick into wax, preferably a vegetable wax. When burning the wick of the present invention, the two pieces of wood separate slightly to create a chimney effect. The two wooden pieces should be attached to ensure the two pieces of wood stay close to each other. Otherwise, if the two pieces warp and separate, the result is two separate out of control flames.

The present invention provides, in a second aspect, a method of manufacturing a wooden wick for use in a wax candle. The method includes selecting a type of wood to be formed into a strip of wood to be used in such wooden wick, then cutting the wood selected into such strip having each of a first predetermined length, a first predetermined width and a first predetermined thickness.

Additionally, the method includes forming a booster member having each of a second predetermined length, a second predetermined width and a second predetermined thickness and then adhering such booster member to such strip of wood. Preferably, an adhesive is selected for adhering the booster member to such strip of wood.

In the preferred embodiment, such method further includes an additional step of ensuring that the strip of wood is clean before such strip of wood is adhered to the booster member, and further that such strip of wood is treated with a liquid wax and that the wooden wick is cured, preferably by baking, prior to use in such candle. It is further preferred that the booster member be soaked in a soy oil prior to adhering it to said strip of wood. Thereafter, said booster member is coated with a wax type material.

Additionally, the method includes an additional step of drying the wooden wick for a predetermined time, generally for about 48.0 hours, prior to use in such candle.

The wooden wick further includes a coloring agent to stain the wooden strip for enhancing a visual appearance thereof. Preferably, such coloring agent is a vegetable type coloring agent.

OBJECTS OF THE INVENTION

It is, therefore, one of the primary objects of the present invention to provide an improved wooden wick for use in a wax candle.

Another object of the present invention is to provide a method of producing such wooden wick.

Still, another object of the present invention is to provide a wooden wick for use in a wax candle which is relatively inexpensive to produce.

Yet another object of the present invention is to provide a wooden wick for a wax candle which has enhanced visual appeal.

An additional object of the present invention is to provide a method of producing a wooden wick for a wax candle which will exhibit enhanced burn qualities.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

BRIEF DESCRIPTION OF THE INVENTION

Figure 1:
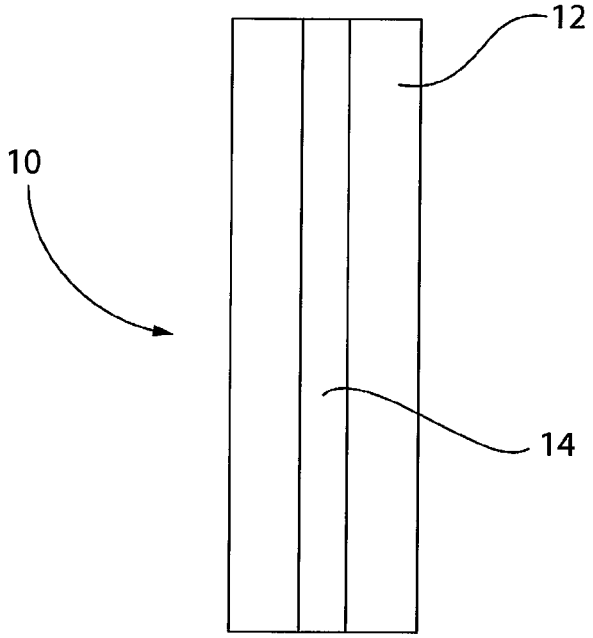
FIG. 1 is a plan view of a wooden wick according to an embodiment of the invention.

Prior to proceeding to the more detailed description of the present invention it should be noted that, for the sake of clarity and understanding, identical components which have identical functions have been identified with identical reference numerals throughout the several views illustrated in the drawing figures.

Figure 2:
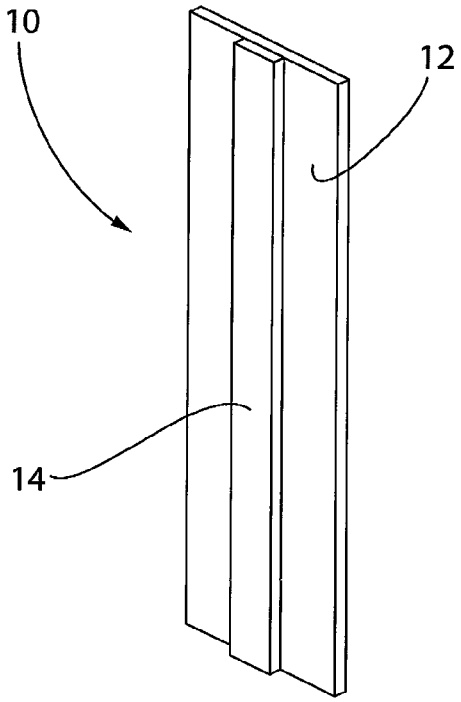
FIG. 2 is a perspective view of a wooden wick according to an embodiment of the invention.
Figure 3:
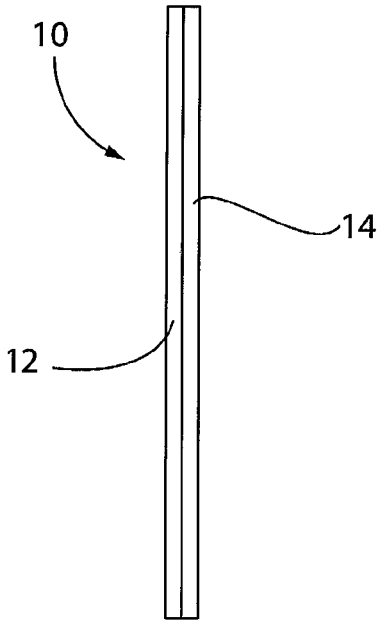
FIG. 3 is a profile view of a wooden wick according to an embodiment of the invention.

Reference is now made, more particularly, to FIGS. 1-3 which show an embodiment of the wick of the present invention. Illustrated therein is a wooden wick, generally designated 10, for use in a wax candle (not shown). The wooden wick 10 includes a strip of a predetermined wood 12 having each of a first predetermined length, a first predetermined width and a first predetermined thickness. Further, the wooden wick, according to the present invention, includes a booster member 14 having each of a second predetermined length, a second predetermined width and a second predetermined thickness.

Figure 4:
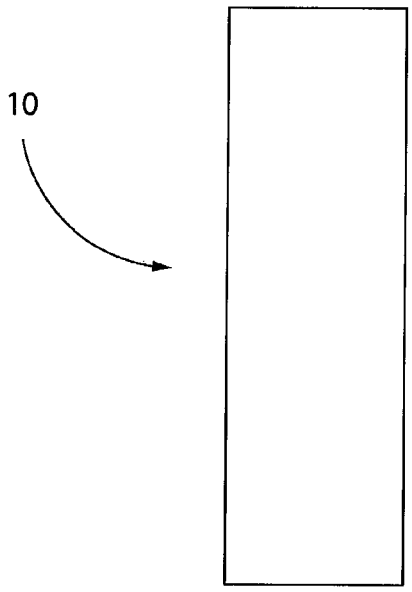
FIG. 4 is a plan view of a wooden wick according to another embodiment of the invention.
Figure 5:
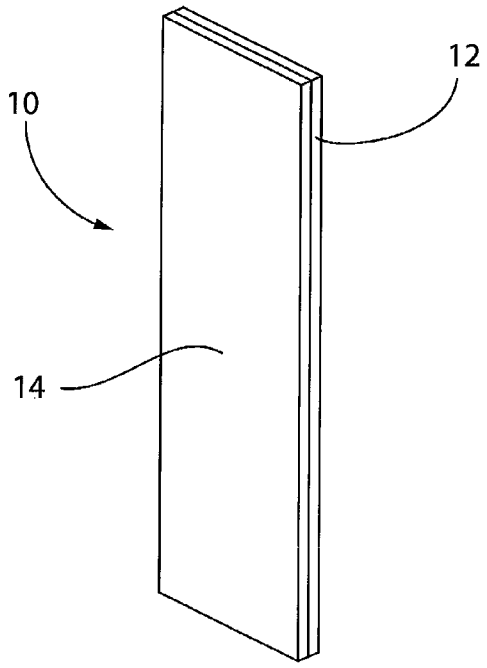
FIG. 5 is a perspective view of a wooden wick according to another embodiment of the invention.
Figure 6:
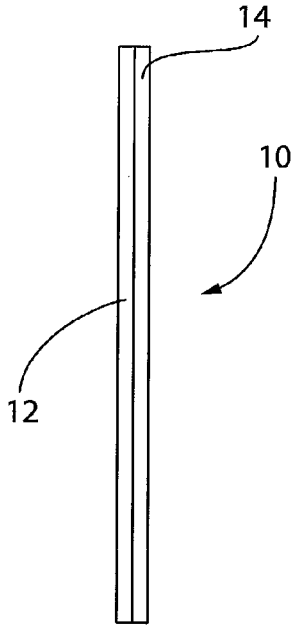
FIG. 6 is a profile view of a wooden wick according to another embodiment of the invention.

Reference is now made, more particularly, to FIGS. 4-6 which show an embodiment of the wick of the present invention. Illustrated therein is a wooden wick, generally designated 10, for use in a wax candle (not shown). The wooden wick 10 includes a strip of a predetermined wood 12 having each of a first predetermined length, a first predetermined width and a first predetermined thickness. Further, the wooden wick, according to the present invention, includes a booster member 14 having each of a second predetermined length, a second predetermined width and a second predetermined thickness.

In one embodiment of the invention, the first predetermined length of such strip of wood 12 will generally be between about 4.375 and about 5.125 inches. In this embodiment, the first predetermined width of the strip of wood 12 will generally be between about 0.70 inch and about 0.80 inch. In one embodiment of the invention, the second predetermined length of such booster member 14 will generally be between about 3.45 and about 3.55 inches, and the second predetermined width of the booster member 14 will generally be between about 0.70 inch and about 0.80 inch. Further, in this embodiment such first and second predetermined thickness will be substantially identical.

Figure 7:
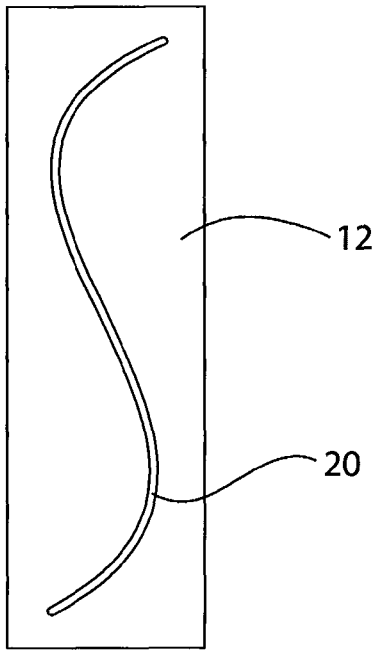
FIG. 7 is a plan view of a wooden wick according to another embodiment of the invention with adhesive applied in an S pattern.
Figure 8:
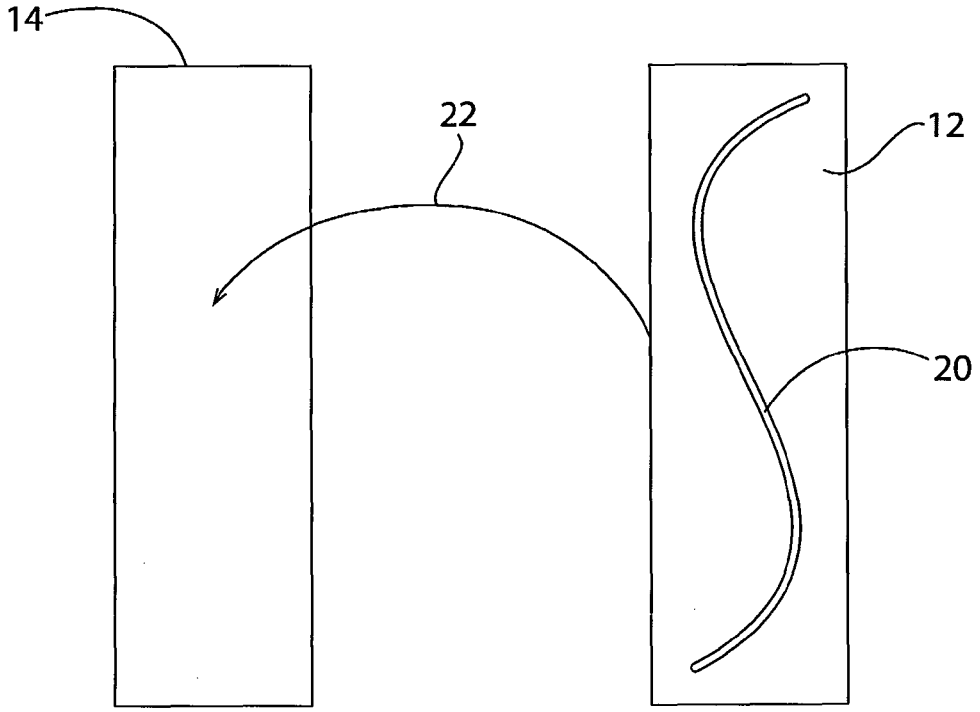
FIG. 8 is a plan view of a wooden wick according to another embodiment of the invention with adhesive applied in an S pattern and booster member ready to receive the wooden wick.

Reference is now made, more particularly, to FIGS. 7 and 8 which show an embodiment of the wick of the present invention in the assembly process. The strip of wood 12 comprises a means for adhering the booster member 14 to such strip of wood 12. Such means is preferably an adhesive 20. Adhesive 20 is preferably applied in an S pattern as shown in FIGS. 7 and 8. The strip of wood 12 is then mated with booster member 14 as directed by directional arrow 22. This configuration has been shown to keep the strip of wood 12 and booster member 14 closely bound to each other while still allowing gases, steam and air to move between the strip of wood 12 and booster member 14. Other means for adhering the booster member to a strip of wood 12 could comprise at least one fastener, clip, band, rivet, epoxy, cement, or the like.

Figure 9:
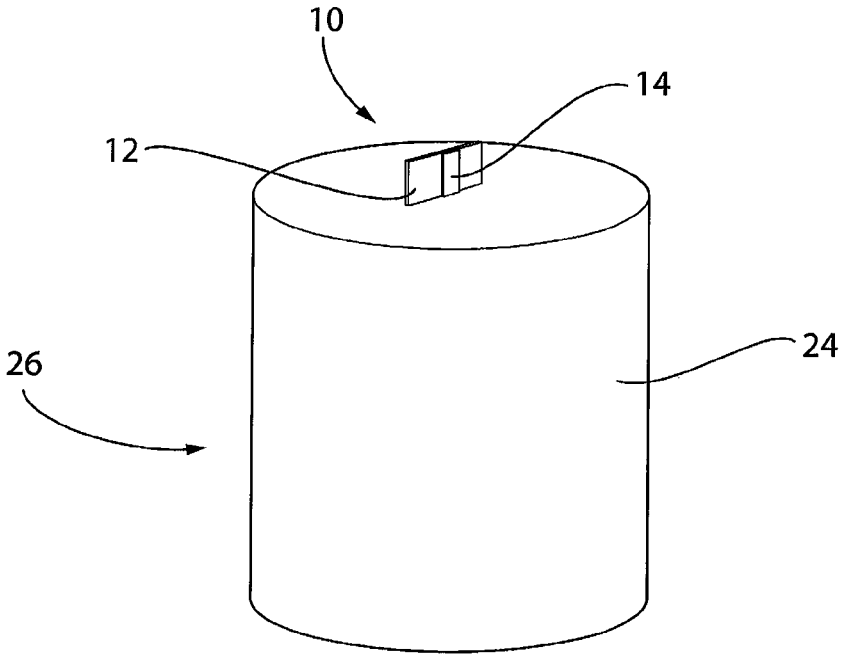
FIG. 9 is a perspective view of a candle comprising a wooden wick with a booster member.

Reference is now made to FIG. 9 which shows the wick 10 embedded in wax 24 to create candle 26.

Figure 10:
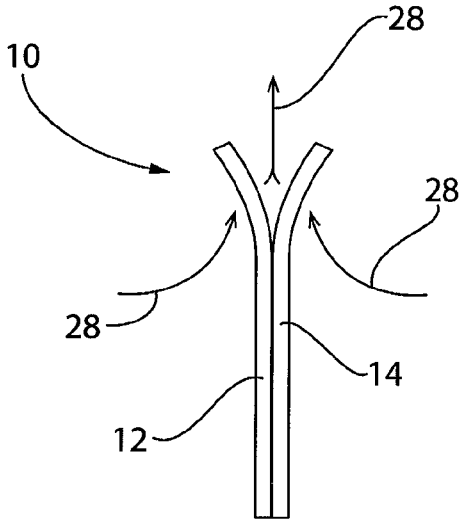
FIG. 10 is a close-up profile view of a portion of the wooden wick with a booster member showing airflow while burning the wick.

Reference is now made to FIG. 10 which shows the wick 10 with directional arrows 28 which indicate the general direction of air and gas movement while the wick 10 is burning. The chimney effect of the wick 10 has a significant effect on the efficient burning of the wick 10 and the candle 26 as a whole. The extent of the peeling away between the wood strip 12 and booster member 14 is exaggerated in this drawing for illustrative purposes.

While presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

The invention claimed is:

1. A wooden wick comprising: (a) a planar strip (b) a planar booster member; and (c) a means for adhering said planar booster member to said strip of wood wherein said means for adhering is selected from the group consisting of an adhesive, a fastener, a clip, a band, a rivet, an epoxy, and a cement, and wherein the planar strip or the planar booster member is treated with a solution comprising vinegar, oil or salt.

2. The wooden wick according to claim 1, wherein said means for adhering said booster member to said planar strip of wood is a clip.

3. The wooden wick according to claim 1, the solution comprises the vinegar.

4. The wooden wick according to claim 1, wherein the solution comprises the oil.

5. The wooden wick according to claim 1, wherein the solution the comprises the salt.

6. The wooden wick according to claim 1, wherein said planar strip comprises a first predetermined thickness and a second predetermined thickness, and wherein said first predetermined thickness and said second predetermined thickness are substantially identical.

7. The wooden wick according to claim 1, wherein the solution comprises the oil, the vinegar, and the salt water.

8. A method of manufacturing a wooden wick comprising the steps of: treating a booster member and a strip of wood with a solution comprising vinegar, oil or salt and adhering said booster member to said strip of wood with a means for adhering selected from the group consisting of an adhesive, a fastener, a clip, a band, a rivet, an epoxy, and a cement.

9. The method of manufacturing a wooden wick according to claim 8 further comprising cleaning said strip of wood before said strip of wood is adhered to said booster member.

10. The method of manufacturing a wooden wick according to claim 8, wherein said solution comprises the oil, the vinegar, and the salt.

11. The method of manufacturing a wooden wick according to claim 10 further comprising curing said wooden wick.

12. The method of manufacturing a wooden wick according to claim 11, wherein said curing step comprises baking.

13. The method of manufacturing a wooden wick according to claim 8 further comprising drying said wooden wick.

14. The method of manufacturing a wooden wick according to claim 13, wherein said drying step is done for 48 hours.

15. The method of manufacturing a wooden wick according to claim 13, wherein said drying step comprises a vacuum and wherein said solution comprises the oil.

16. The wooden wick according to claim 4, wherein the oil is a soy oil.

17. The method of manufacturing a wood wick according to claim 8, wherein the solution comprises the oil.

18. The method of manufacturing a wood wick according to claim 8, wherein the oil is a soy oil.

19. The wood wick according to claim 1, wherein the planar strip has a first predetermined width and the planar booster member has a second predetermined width, wherein the first predetermined width is between about 0.70 inches and about 0.80 inches and the second predetermined width is between about 0.70 inches and about 0.80 inches.

20. The method of manufacturing a wood wick according to claim 8, wherein the strip of wood has a first predetermined width and the booster member has a second predetermined width, wherein the first predetermined width is between about 0.70 inches and about 0.80 inches and the second predetermined width is between about 0.70 inches and about 0.80 inches.

* * * * *